US008506360B1

(12) United States Patent
Larson

(10) Patent No.: US 8,506,360 B1
(45) Date of Patent: Aug. 13, 2013

(54) WINE GLASS POLISHER

(76) Inventor: Jeffrey Larson, Lawrenceville, GA (US)

( * ) Notice: Subject to any disclaimer, the term of this patent is extended or adjusted under 35 U.S.C. 154(b) by 262 days.

(21) Appl. No.: 12/817,655

(22) Filed: Jun. 17, 2010

Related U.S. Application Data

(60) Provisional application No. 61/221,834, filed on Jun. 30, 2009.

(51) Int. Cl.
*B24B 9/00* (2006.01)

(52) U.S. Cl.
USPC ..... 451/67; 451/64; 451/66

(58) Field of Classification Search
USPC ..... 451/64, 66, 67
See application file for complete search history.

(56) References Cited

U.S. PATENT DOCUMENTS

| | | | | |
|---|---|---|---|---|
| 6,884,392 | B2 * | 4/2005 | Malkin et al. | 422/26 |
| 2004/0197248 | A1 * | 10/2004 | Hasegawa et al. | 422/297 |
| 2011/0030736 | A1 * | 2/2011 | Geissler et al. | 134/30 |

* cited by examiner

*Primary Examiner* — Lee D Wilson
*Assistant Examiner* — Shantese McDonald
(74) *Attorney, Agent, or Firm* — Kenneth L Tolar

(57) ABSTRACT

A wine-glass polisher includes a base unit having a frusto-conical cleaning chamber removably fastened thereto. A steam generator, an air heater and a vacuum pump are each in fluid communication with the cleaning chamber. A portion of the steam and hot air is directed to a channel formed in the chamber outer wall. An annular, U-shaped baffle surrounding the open top is in fluid communication with the channel for projecting the steam and hot air downwardly toward a wine glass below. A remaining portion of the heated air and steam is delivered directly to the upper surface of the base unit to clean and dry the interior surface of the glass. A controller first initiates a polishing cycle by activating the vacuum pump and steam generator. Upon expiration of the predetermined duration, the controller activates the blower to dry the exterior and interior surfaces of the glass.

4 Claims, 2 Drawing Sheets

WINE GLASS POLISHER

CROSS REFERENCE TO RELATED APPLICATIONS

This application is entitled to the benefit of provisional application No. 61/221,834 filed on Jun. 30, 2009, the specification of which is incorporated herein by reference.

BACKGROUND OF THE INVENTION

The present invention relates to a wine-glass polisher.

DESCRIPTION OF THE PRIOR ART

Properly cleaning wine glasses has always been arduous and time-consuming. After the glass has been cleansed with soap and water, stains normally form as the glass dries. As a result, the glass must be steamed and then manually polished with a towel to remove the stains. The procedure is not only time-consuming, but also leads to glass breakage and personal injuries when a worker inserts his or her hand into the glass. Accordingly, there is currently a need for an easier method of cleaning and polishing wine glasses. The present invention addresses this need by providing a cleaning device that automatically steams and dries wine glasses to remove stains.

SUMMARY OF THE INVENTION

The present invention relates to a wine-glass polisher including a base unit having a frustoconical cleaning chamber removably fastened thereto. A steam generator, an air heater and a vacuum pump are each in fluid communication with the cleaning chamber. A portion of the steam and hot air is directed to a channel formed in the chamber outer wall. An annular, U-shaped baffle surrounding the open top is in fluid communication with the channel for projecting the steam and hot air downwardly toward a wine glass below. A remaining portion of the heated air and steam is delivered directly to the upper surface of the base unit to clean and dry the interior surface of the glass. To polish a wine glass, a user positions the glass within the cleaning chamber in an inverted position and initiates an automated polishing cycle. Steam is delivered to the baffle where it is directed downwardly to blanket the wine glass exterior. The remaining portion of steam is delivered directly to the base unit where it is projected into the wine glass interior. The vacuum source simultaneously removes the steam and any condensation from the chamber. After a predefined duration, the steam generator is automatically disabled and the air heater is activated for a second predetermined duration to dry both the interior and exterior surfaces of the glass.

It is therefore an object of the present invention to provide a device that automatically polishes a wine glass.

It is another object of the present invention to provide a glass polisher that quickly, safely and easily polishes a wine glass.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
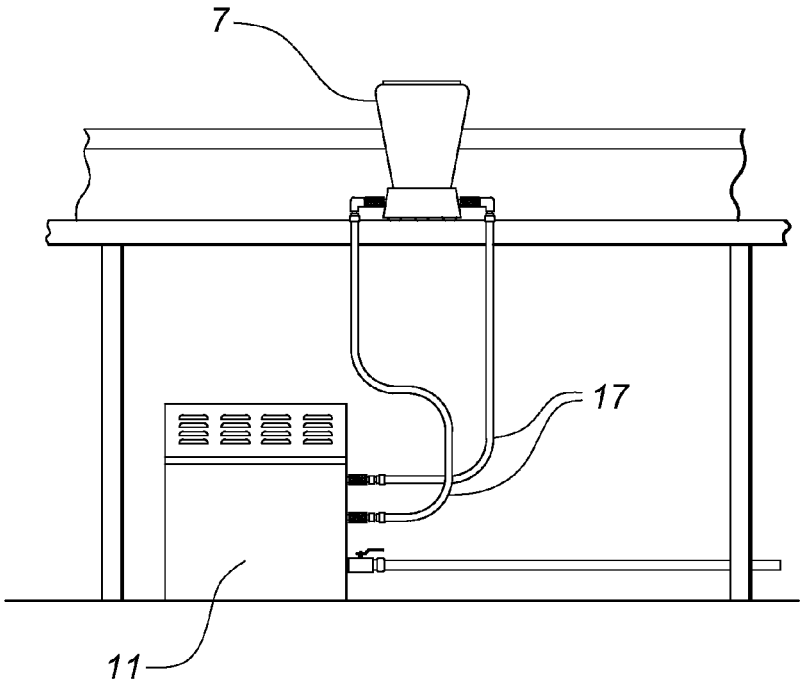
FIG. 1 is a plan view of the glass polisher according to the present invention.
Figure 2:
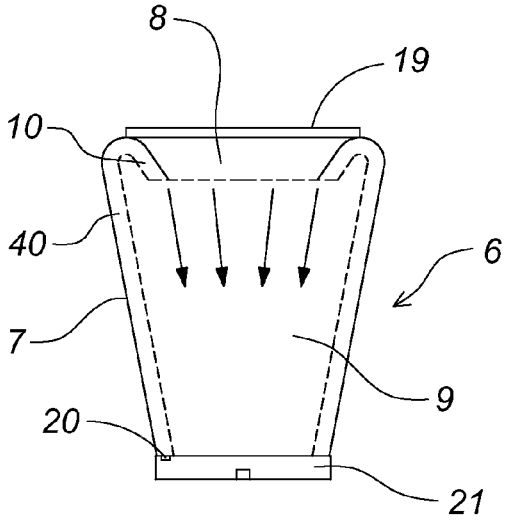
FIG. 2 is a front, cross-sectional view of the cleaning chamber.
Figure 3:
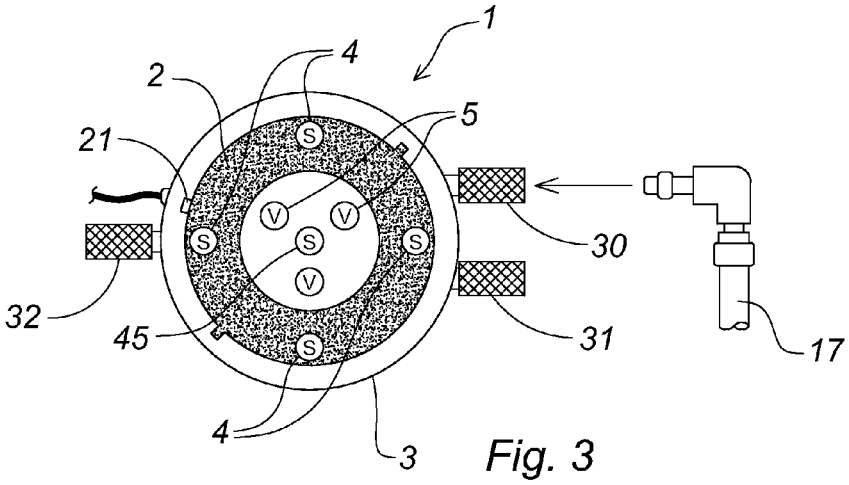
FIG. 3 is a top view of the base unit.
Figure 4:
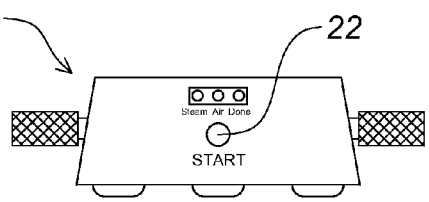
FIG. 4 is a side view of the base unit.
Figure 5:
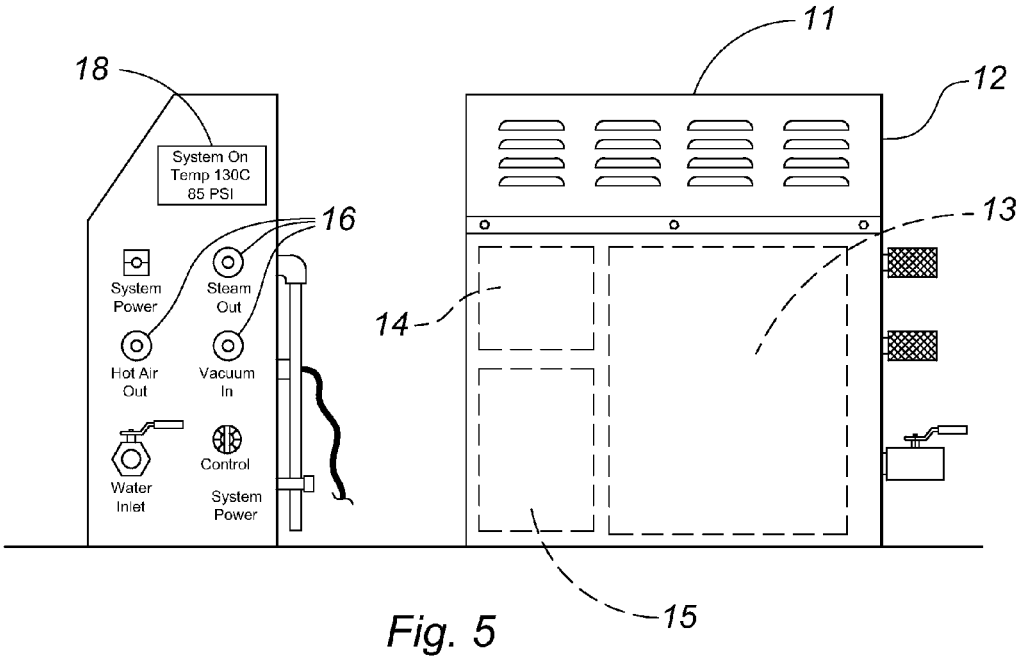
FIG. 5 is an isolated view of the cleaning unit.

The present invention relates to a wine glass polisher comprising a base unit 1 having an upper surface 2, a lower surface and an outer periphery 3. On the upper surface are a plurality of apertures each in fluid communication with one of three inlets 3 on the unit's periphery. A first set of apertures 4 are in fluid communication with both a hot air inlet port 30 and a steam inlet port 31 while a second set 5 are in discrete fluid communication with a vacuum port 32.

Removably fastened to the base unit is a frustoconical cleaning chamber 6 having a mesh bottom surface, a continuous outer wall 7 and an open top 8 in communication with an interior compartment 9. The interior compartment is dimensioned to accommodate any conventional wine glass in an upright or inverted orientation. Within the outer wall is at least one channel 40 that is in fluid communication with the hot air port 30 and steam port 31 when the chamber is properly mounted on the base unit. The open top is defined by an annular, U-shaped baffle 10 in communication with the channel 40 that directs steam and hot air downwardly toward a wine glass below. A central aperture 45 is also in communication with the ports 30,31 to cleanse and dry the interior surface of the glass.

A cleaning unit 11 includes a housing 12 having a steam generator 13, a heated air blower 14 and a vacuum pump 15 received therein, each of which is in discrete communication with a designated outlet port 16 on the housing exterior. The steam generator includes a water reservoir having an electronic level sensor that disables the generator if the fluid level is below a predetermined threshold. An insulated steam reservoir includes pressure and temperature sensors for maintaining steam at a desired temperature and pressure while a safety relief valve releases steam if the temperature or pressure exceeds a recommended level. A color-coded hose 17 is connected to each one of the outlet ports and to a corresponding inlet port on the base unit using quick-connect fittings. A controlling computer actuates the vacuum pump or a solenoid on either of the hot air hose or the steam hose to initiate a drying cycle or steaming cycle as described below. An LCD 18 depicts the current status and operational parameters of any polishing cycle.

The open top of the chamber includes a circumferential optical sensor 19 that disables the steam generator or air blower if a person inserts a hand or other opaque object into the cleaning chamber during operation. An electrical connector 20 on the chamber bottom surface mates with a second connector on the base unit 21 to power the sensor.

To polish a wine glass, a user inverts the glass, positions it in the cleaning chamber and initiates a polishing cycle by depressing a START 22 button on the base unit. Steam is delivered to the circumferential channel where the baffle directs the steam downwardly to blanket the glass exterior and stem.

Simultaneously, steam is projected from the central aperture 45 into the glass interior. The vacuum pump operates simultaneously to remove the steam and any condensation from the cleaning chamber. After a predefined duration, the computer automatically disables the steam generator, and simultaneously activates the heated air blower for a predetermined duration to dry both the glass exterior and interior.

The above-described device is not limited to the exact details of construction and enumeration of parts provided herein. For example, the device depicted and described is primarily designed for commercial use; however, all of the above-described components could be downsized and incorporated into a single unit to provide a counter top polisher for home use. Furthermore, the polisher could also be used to polish other types of glasses or containers in addition to wine glasses. Finally, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A glass polisher comprising:

a cleaning chamber dimensioned and configured to retain a beverage container;

means for delivering steam to said cleaning chamber for a first predetermined duration, wherein said means for delivering steam to said cleaning chamber for a first predetermined duration includes a steam generator in fluid communication with said cleaning chamber, and a controller connected to said steam generator for activating said steam generator upon receiving a command;

means for removing the steam from said cleaning chamber for said first predetermined duration;

means for delivering hot air to said cleaning chamber for a second predetermined duration to produce a dry, spotless beverage container, wherein said means for delivering hot air to said cleaning chamber for a second predetermined duration includes a heated air blower in fluid communication with said chamber and connected to said controller, said blower activated for said second predetermined duration upon the expiration of said first predetermined duration.

2. The polisher according to claim 1 wherein said means for removing the steam from said cleaning chamber for said first predetermined duration comprises:

a vacuum pump in fluid communication with said cleaning chamber and connected to said controller, said pump activated upon receiving said command.

3. The polisher according to claim 1 wherein said cleaning chamber includes an open top in communication with an interior compartment, said open top defined by an annular, U-shaped baffle in communication with said hot air blower and said steam generator that projects steam and hot air downwardly toward said beverage container below.

4. The polisher according to claim 3 wherein said open top includes a circumferential optical sensor that disables either of said steam generator and said air blower if an object is inserted into said cleaning chamber while either of said steam generator and said blower is operating.

* * * * *